US005375663A

United States Patent [19]

Teach

[11] Patent Number: 5,375,663

[45] Date of Patent: Dec. 27, 1994

[54] EARTHMOVING APPARATUS AND METHOD FOR GRADING LAND PROVIDING CONTINUOUS RESURVEYING

[75] Inventor: Ted L. Teach, Dayton, Ohio

[73] Assignee: Spectra-Physics Laserplane, Inc., Dayton, Ohio

[21] Appl. No.: 42,092

[22] Filed: Apr. 1, 1993

[51] Int. Cl.[5] ..... E02F 3/76

[52] U.S. Cl. ..... 172/4.5; 364/424.07; 356/375; 37/907

[58] Field of Search ..... 172/4, 4.5, 6; 37/907; 364/424.07; 356/375

[56] References Cited

U.S. PATENT DOCUMENTS

| | | | |
|---|---|---|---|
| 3,494,426 | 2/1970 | Studebaker . | |
| 3,680,958 | 8/1972 | Von Bose . | |
| 3,873,226 | 3/1975 | Teach . | |
| 3,953,145 | 4/1976 | Teach . | |
| 4,107,859 | 8/1978 | Keith | 37/907 |
| 4,273,196 | 6/1981 | Etsusaki et al. . | |
| 4,537,259 | 8/1985 | Funabashi et al. | 172/4.5 |
| 4,573,124 | 2/1986 | Seiferling | 364/424.07 |
| 4,630,773 | 12/1986 | Ortlip | 239/1 |
| 4,727,329 | 2/1988 | Behr | 324/345 |
| 4,733,355 | 3/1988 | Davidson et al. | 364/424.07 |
| 4,740,792 | 4/1988 | Sagey et al. | 342/457 |
| 4,775,940 | 10/1988 | Nishida et al. | 364/424.07 |
| 4,807,131 | 2/1989 | Clegg | 172/4.5 |
| 4,818,107 | 4/1989 | Ono et al. | 356/375 |
| 4,819,053 | 4/1989 | Halavais | 342/353 |
| 4,820,041 | 4/1989 | Davidson et al. . | |
| 4,914,593 | 4/1990 | Middleton et al. . | |
| 4,918,608 | 4/1990 | Middleton et al. . | |
| 4,933,853 | 6/1990 | Musil et al. | 364/424.07 |
| 5,005,652 | 4/1991 | Jonnson | 172/4.5 |
| 5,065,326 | 11/1991 | Sahm | 364/424.07 |
| 5,144,317 | 9/1992 | Duddek et al. . | |
| 5,150,310 | 9/1992 | Greenspun et al. | 364/516 |
| 5,174,385 | 12/1992 | Shinbo et al. . | |
| 5,184,293 | 2/1993 | Middleton et al. . | |

FOREIGN PATENT DOCUMENTS

| | | | |
|---|---|---|---|
| 1464063 | 12/1966 | France | 172/4.5 |
| 2268295 | 11/1975 | France | 172/4.5 |
| 2919505 | 11/1979 | Germany . | |
| 3827618 | 2/1990 | Germany | 172/4.5 |
| 1-235733 | 9/1989 | Japan | 172/4.5 |
| 629288 | 9/1978 | U.S.S.R. | 172/4.5 |

*Primary Examiner*—Eric K. Nicholson

*Attorney, Agent, or Firm*—Killworth, Gottman, Hagan & Schaeff

[57] ABSTRACT

An earthmoving apparatus and method for grading a tract of land to a desired finish contour wherein a continuously updated contour map is displayed to the operator of the earthmoving apparatus during the grading process is provided. The earthmoving apparatus has a blade of known width for cutting and filling soil of the tract of land. Vertical blade movement and the x and y position of the earthmoving apparatus is continually detected by respective sensors as the earthmoving apparatus traverses the tract of land. An ultrasonic transmitter and receiver detects elevation of the soil, preferably located behind the blade, to provide updated soil elevation information. A computer then uses the aforesaid information to generate a visual representation of a contour map of the tract of land with cut and fill lines thereon. The computer continuously modifies the contour map to reflected changes in the topography of the tract of land as the earthmoving apparatus proceeds with the grading process based on the detected elevation of the soil, the blade width, the x and y position of the apparatus and the desired finish contour.

18 Claims, 3 Drawing Sheets

EARTHMOVING APPARATUS AND METHOD FOR GRADING LAND PROVIDING CONTINUOUS RESURVEYING

BACKGROUND OF THE INVENTION

The present invention relates generally to grading, or landleveling, a tract of land to a desired finish contour and, more particularly, to an earthmoving apparatus and method for grading a parcel of land wherein a contour map is displayed to the operator of the earthmoving apparatus and is continually updated during the grading process. The contour map incorporates topographical changes in the land as the earthmoving apparatus traverses the tract until the desired finish contour is obtained.

Landleveling is a process commonly used in the agricultural industry to control water flow and accumulation on a field. Typically, the field is initially topographically surveyed and a graphical representation of its existing contour is produced. Based on this graphical representation of the existing land contour and a predetermined desired finish contour of the land, a contour map having cut and fill lines is created. Although cut and fill lines resemble conventional contour lines, which denote constant or iso-elevation, such cut and fill lines actually indicate the amount of cut or fill necessary to reach the desired finish contour. The operator of the earthmoving apparatus then uses the contour map as a guide in landleveling the field.

Operators of earthmoving equipment have experienced a significant problem with the contour map of the above described system. During the landleveling process, the cut and fill lines on the contour map remain unchanged even though the contour of the land has changed. Thus, the map becomes less useful as the work proceeds. Frequently, the field has to be re-surveyed before reaching the desired finish contour.

U.S. Pat. No. 4,820,041 issued to Davidson et al discloses a laser-based position sensing system for grading a tract of land with an earthmoving apparatus. The tract of land is surveyed and a site plan is drawn up illustrating the desired finish contour. From the tract survey and the site plan, a cut-fill map is produced showing amounts of cut or fill needed in individual portions of the tract of land to produce the desired finish contour. The information in the cut-fill map is then stored in a computer on the earthmoving apparatus.

The earthmoving apparatus is equipped with a laser receiver mast which is coupled to the grading implement of the apparatus. The laser receiver mast is positioned to intercept a datum laser plane above the tract of land. The datum laser plane is generated by two rotating laser transmitters above the tract of land. The planar position of the laser receiver mast, and thus the earthmoving apparatus, is determined by conventional triangulation techniques.

The vertical intercept point of the laser beam on the laser receiver mast, which is indicative of elevation of the grading implement, is provided to the computer which calculates elevation error of the grading implement based on the cut-fill map and the detected planar position of the apparatus. The elevation error may be communicated to the operator of the earthmoving apparatus who can then make the appropriate adjustments manually or the computer may automatically adjust the elevation of the grading implement to reduce the elevation error.

The just described Davidson system may experience problems when the earthmoving apparatus is filling an area of the tract of land. During filling, the operator of the earthmoving apparatus positions the grading implement at the appropriate level and pushes soil into the area to be filled. However, a problem arises when there is insufficient soil to cover the area to be filled. Since the grading implement remains at the required level, the positioning system of Davidson et al will indicate that the proper contour has been graded when, in fact, the area is below the desired level.

U.S. Pat. No. 5,144,317 issued to Duddek et al discloses a method for determining mining progress in open cast mining using satellite geodesy. The position of an extraction device, such as a bucket wheel of a bucket wheel digger, is monitored by analyzing signals received from at least four satellites. The geometry of the mine during the mining operation may be continuously deduced and displayed on a picture screen. However, the Duddek et al invention calculates the amount of soil, or deposit material, removed during a single cut based on the position and physical dimensions of the bucket wheel. Consequently, as previously discussed with respect to the Davidson et al system, the Duddek et al method fails to address the aforementioned problem of erroneous measurements when there is insufficient soil to cover the area to be filled.

Accordingly, the need exists in the art for an improved earthmoving apparatus and method for grading a tract of land wherein a contour map having cut and fill lines thereon is continually and accurately modified as the earthmoving apparatus traverses the tract of land.

SUMMARY OF THE INVENTION

This need is met by an earthmoving apparatus and method in accordance with the present invention for grading a tract of land to a desired finish contour wherein a continuously updated contour map is displayed to the operator of the earthmoving apparatus during the grading process. The earthmoving apparatus has a blade of known width for cutting and filling soil of the tract of land. Vertical blade movement and the x and y position of the earthmoving apparatus is continually detected by respective blade movement sensor means and position sensor means as the earthmoving apparatus traverses the tract of land. An elevation sensor means, which may comprise an ultrasonic transmitter and receiver, detects elevation of the soil, preferably located behind the blade, to provide updated soil elevation data. A computer then uses the aforesaid information to generate a visual representation of a contour map of the tract of land with cut and fill lines thereon. The computer continuously modifies the contour map to reflected changes in the topography of the tract of land as the earthmoving apparatus proceeds with the grading process based on the detected elevation of the soil, the blade width, the x and y position of the apparatus and the desired finish contour.

Preferably, blade movement sensor means comprises a laser light transmitting means for generating a plane of laser light above the tract of land and a laser light detection means connected to the blade for detecting vertical movement of the blade relative to the plane of light. The laser light detection means may comprise a laser receiver mast including a linear array of photodetectors.

The computer means may preferably display the x and y position of the earthmoving apparatus on the contour map as the apparatus traverses the tract of land. To fully automate the grading process, blade movement means may be provided for automatically regulating the position of the blade in response to the x and y position of the apparatus and the cut and fill lines of the contour map.

In accordance with another embodiment of the present invention, an earthmoving apparatus having a blade of known width and a cutting edge for cutting and filling soil of a tract of land and blade movement means for controlling vertical movement of the blade is provided for grading the tract of land to a desired finish contour. The earthmoving apparatus further comprises soil elevation means for detecting the elevation of the soil with respect to the elevation of the cutting edge of the blade and position sensor means for detecting x and y position of the apparatus as the apparatus traverses the tract of land. Computer means displays and continuously updates a contour map of the tract of land based on the elevation of the soil with respect to the elevation of the cutting edge of the blade, the blade width, the x and y position of the apparatus and the desired finish contour. The contour map having cut and fill lines thereon indicative of the cut and fill required to produce the desired finish contour.

Preferably, the soil elevation means for detecting the elevation of the soil with respect to the elevation of the cutting edge of the blade comprises blade movement sensor means for detecting elevation of the blade as the apparatus traverses the tract of land. Elevation sensor means, which may comprise an ultrasonic transmitter and receiver, is included for continuously detecting the elevation of a portion of the soil located behind the blade relative to the elevation of the blade as the apparatus traverses the tract of land.

For fully automatic operation, the computer means generates blade movement signals based on the elevation of the blade, the elevation of the portion of the soil, the blade width, the x and y position of the apparatus and the desired finish contour, and the blade movement means automatically controls the blade in response to the blade movement signals as the apparatus traverses the tract of land to produce the desired finish contour.

In accordance with yet another embodiment of the present invention, a method for grading a tract of land to a desired finish contour using an earthmoving apparatus having a blade of a known width and computer means for displaying a contour map of the tract of land is provided. The method comprising the steps of: surveying the tract of land; generating and displaying the contour map having cut and fill lines thereon based on the survey and the desired finish contour; traversing the tract of land using the blade of the earthmoving apparatus to cut and fill soil of the tract of land; sensing elevational changes of the soil as the earthmoving apparatus traverses the tract of land; continuously determining the x and y position of the earthmoving apparatus as the earthmoving apparatus traverses the tract of land; and modifying and displaying the contour map to reflect changes in the tract of land continuously as the apparatus traverses the tract of land based on the elevational changes of the soil, the width of the blade and the x and y position of the earthmoving apparatus.

Preferably, the step of modifying the contour map further comprises the step of indicating on the contour map the x and y position of the apparatus as the apparatus traverses the tract of land. The step of sensing elevational changes of the soil may include the step of sensing elevational changes of the soil located behind the blade.

The step of sensing elevational changes of the soil may preferably further comprise the steps of: transmitting ultrasonic waves toward the soil located behind the blade; detecting reflections of the ultrasonic waves from the soil located behind the blade; calculating travel time of the waves; and determining elevation of the soil located behind the blade based on the travel time of the waves.

Alternatively, the step of sensing elevational changes of the soil may further comprise the steps of: transmitting a plane of laser light above the tract of land; detecting vertical movement of the blade relative to the plane of laser light; transmitting ultrasonic waves toward the soil located behind the blade; detecting reflections of the ultrasonic waves from the soil located behind the blade; calculating travel time of the waves; and determining the elevation of the soil located behind the blade based on the vertical movement of the blade and the travel time of the waves.

It is thus a feature of the present invention to provide an improved earthmoving apparatus and method for grading a tract of land to a desired finish contour wherein an accurate, updated contour map of the tract of land is continuously displayed to an operator of the apparatus.

Other features and advantages of the invention will be apparent from the following description, the accompanying drawings and the appended claims.

DETAILED DESCRIPTION OF THE INVENTION

Figure 1:
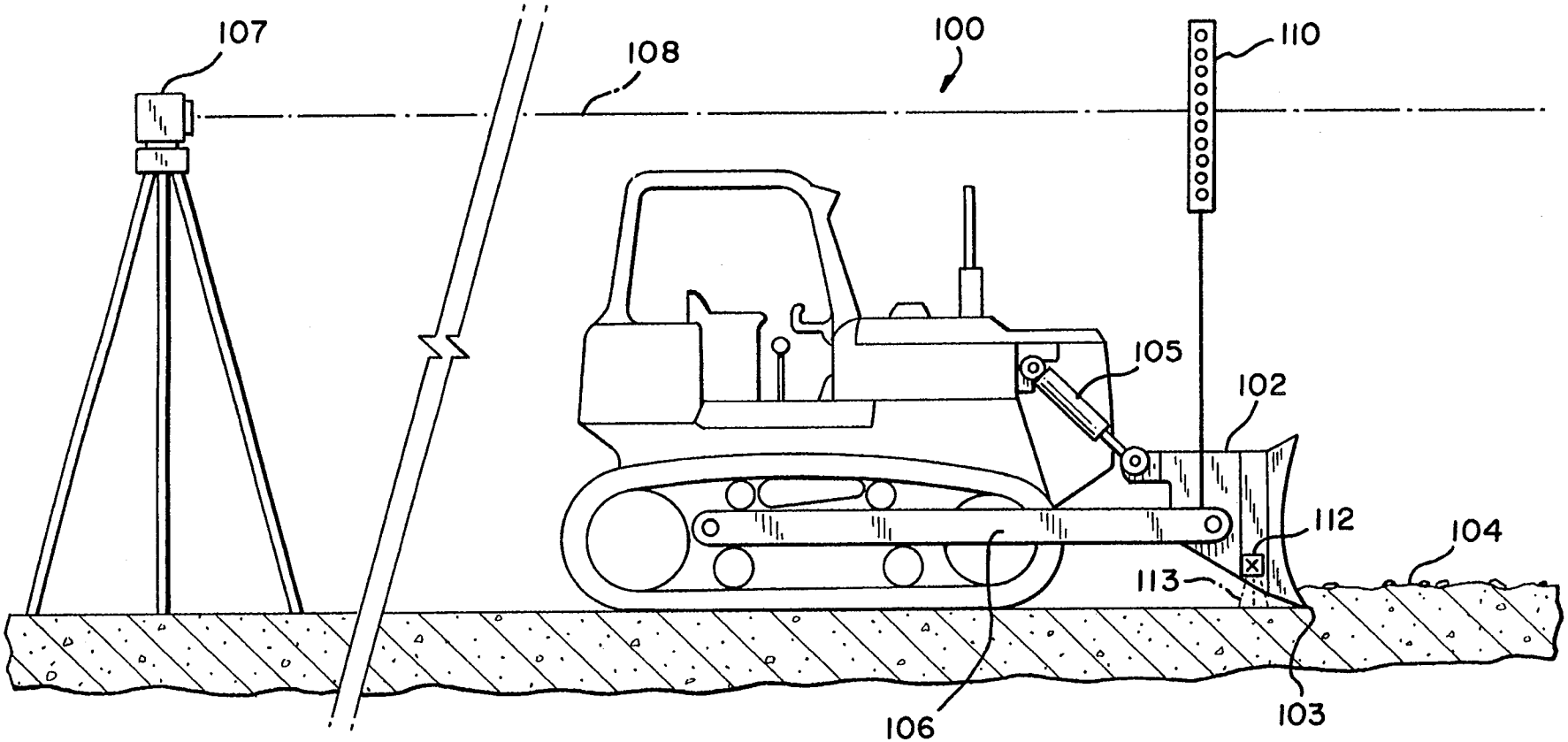
FIG. 1 is a side elevational view of an earthmoving apparatus having a laser receiver mast and an ultrasonic transmitter and receiver in accordance with the present invention.

Reference is now made to FIG. 1 which shows an earthmoving apparatus 100 having a blade 102 with a cutting edge 103 for cutting and filling soil 104. The position of the blade 102 is controlled via a blade movement means, shown as hydraulic cylinder 105. It will be appreciated that while a single hydraulic cylinder is shown for purposes of simplicity, the blade of an earthmoving apparatus will actually be positioned by a plurality of such cylinders. Support member 106 stabilizes the blade 102 during the grading operation. Although the earthmoving apparatus 100 is illustrated as a bulldozer, any machine using a blade or other grading implement to cut and fill soil can advantageously employ the present invention, as will be readily apparent to those skilled in the art from the present disclosure. A blade movement sensor means for detecting vertical movement of the blade 102 comprises a laser light transmitter means 107 and a laser light detection means 110. The laser light transmitting means 107 generates a plane of laser light 108 above the soil 104. A number of such laser light transmitting means for generating a plane of laser light are known in the art. Since the structure and philosophy of the laser light transmitting means 107 are not important to the present invention, beyond the generation of a reference plane of light 108 above the soil 104, details of the laser light transmitting means 107 will not be further disclosed herein.

The laser light detection means 110 may be a laser receiver mast having an array of photodetectors. The laser receiver mast senses the impingement of the plane of laser light 108 thereon and generates a signal representative of this impingement. Numerous laser receiver mast designs are well known in the art and, thus will not be further discussed herein.

An elevation sensor means, shown as a conventional ultrasonic transmitter and receiver 112 in FIG. 1, senses changes in elevation of the soil 104 behind the blade 102. As the earthmoving apparatus 100 traverses the soil 104, the ultrasonic transmitter and receiver 112 emits ultrasonic waves 113 which strike a portion of the soil 104 behind the blade 102. The waves 113 are reflected by the soil 104 and the reflections detected by the ultrasonic transmitter and receiver 112. The travel time of the wave is proportional to the distance between the ultrasonic transmitter and receiver 112 and the soil 104. Consequently, by monitoring the time between transmission and reception of an ultrasonic wave, the elevation of the soil 104 behind the blade 102 is determined.

Figure 2:
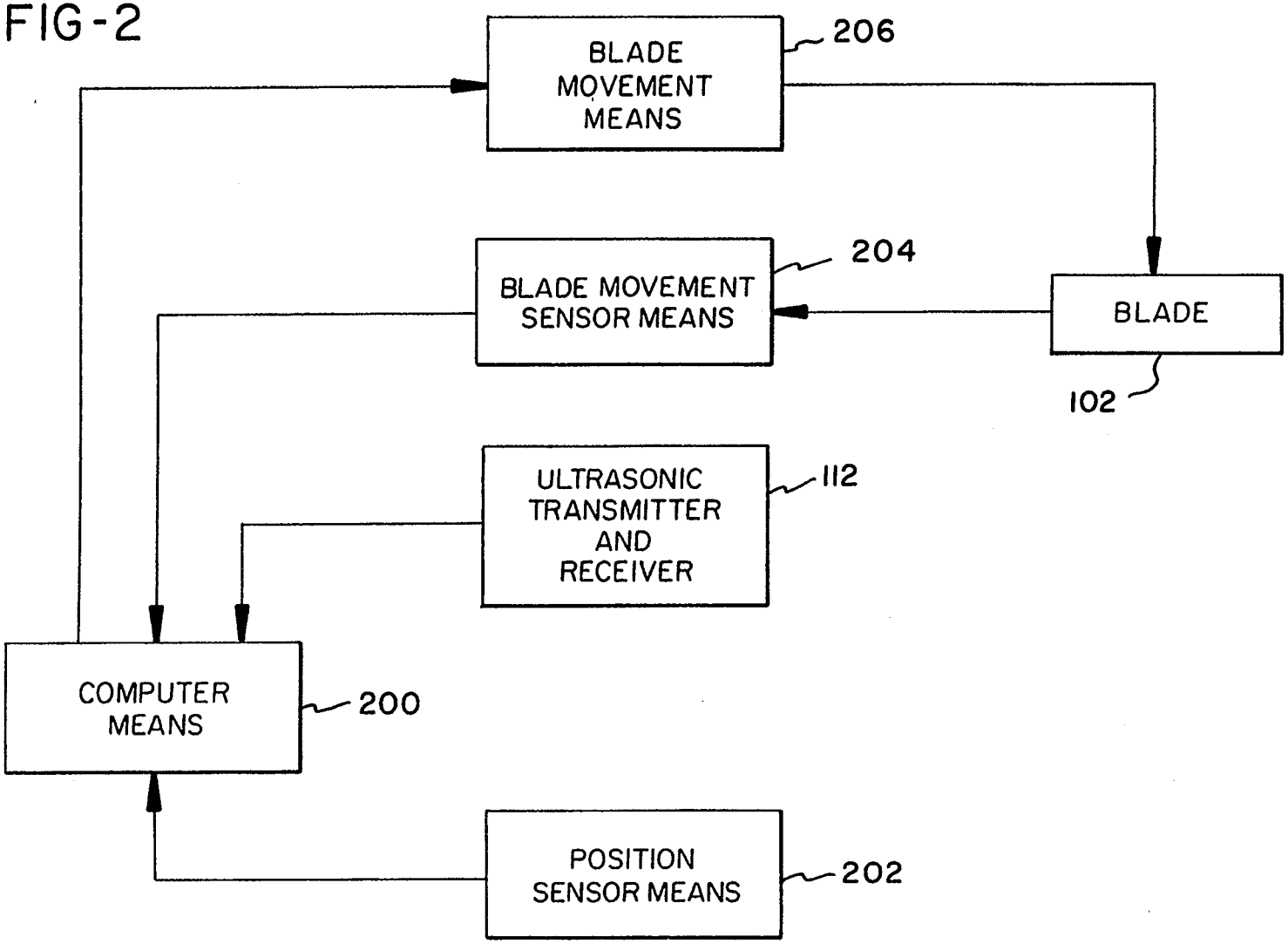
FIG. 2 is a block diagram of the control system in the earthmoving apparatus of FIG. 1 in accordance with the present invention.
Figure 3:
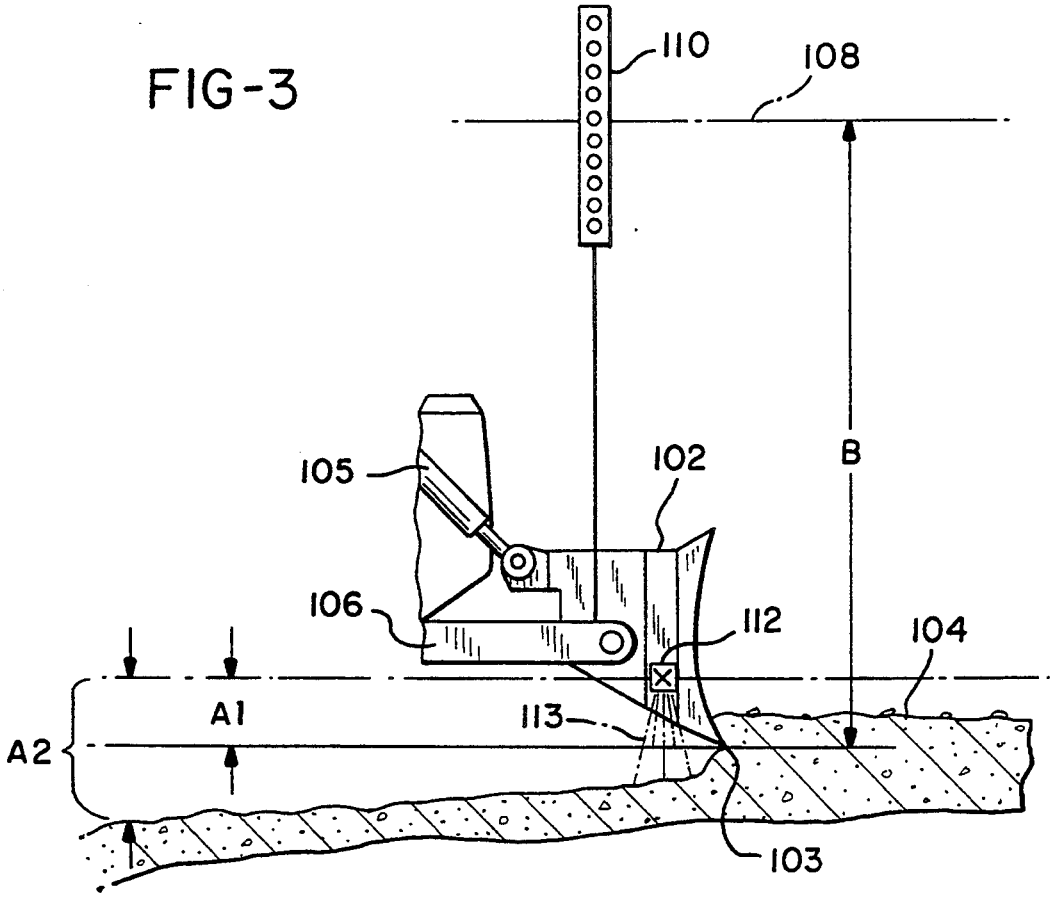
FIG. 3 is a partial view of a blade of the earthmoving apparatus shown in FIG. 1.
Figure 4:
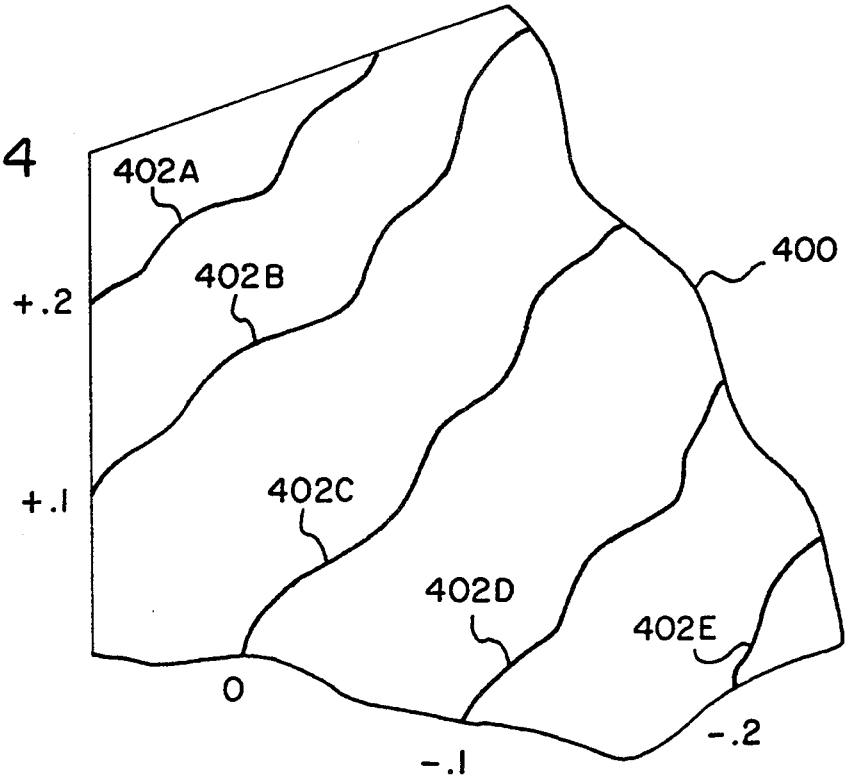
FIG. 4 is a plan view of a contour map having exemplary cut and fill lines.

The operation of the present invention will now be discussed with reference to FIGS. 2 through 4. Initially a contour map, shown in FIG. 4 at 400, of the site to be graded is prepared and stored in a computer means 200. The contour map 400 has iso-cut and iso-fill lines 402A through 402E drawn thereon representing the amount of cut or fill necessary to produce the desired finish contour. Contour maps having iso-cut and iso-fill lines are well known in the art. The computer means 200 has a conventional video screen (not shown) for displaying the contour map 400 to an operator of the earthmoving apparatus 100.

Referring again to FIG. 2, position sensor means 202 senses the x and y coordinates of the earthmoving apparatus 100 relative to a predetermined reference point, as the apparatus traverses the field. Two dimensional position sensing devices are well known in the art. For example, global positioning system (GPS) receivers determine position by analyzing radio frequency signals received from global positioning system satellites. One such GPS receiver is disclosed in U.S. Pat. No. 5,175,557 issued to King et al which is incorporated herein by reference. Laser-based position sensing systems, such as is disclosed in U.S. Pat. No. 4,820,041 issued to Davidson et al, are also well known in the art. It should be understood that the aforementioned position sensing devices are intended to be for illustrative purposes only. As should be apparent to those skilled in the art, any two dimensional position sensing device may be advantageously used in the present invention.

The computer means 200 receives the x and y coordinate position of the earthmoving apparatus 100 from the position sensor means 202. The position of the earthmoving apparatus 100 may then be visually depicted on the contour map 400 by an appropriate icon. The icon traverses the contour map 400 reflecting the real time movements of the earthmoving apparatus 100.

Computer means 200 receives signals from the blade movement sensor means 204 and the ultrasonic transmitter and receiver 112 indicative of vertical blade position and soil elevation behind the blade. Blade movement sensor means 204 and ultrasonic transmitter and receiver 112 comprise soil elevation means for determining the elevation of the soil with respect to the elevation of the cutting edge 103 of the blade 102. The width of the blade 102 is also provided to the computer means 200 via an input device, such as a keyboard (not shown). The computer means 200 uses the aforementioned data to continually update the iso-cut and iso-fill lines on the contour map 400 to reflect any changes in the contour of the land during grading.

The earthmoving apparatus 100 of the present invention may also be fully automated. In fully automated operation, the computer means 200 generates blade movement signals representative of desired blade movement based on the current x and y position of the apparatus and the desired finish contour. A blade movement means 206, shown as hydraulic cylinder 105 in FIG. 1, moves the blade 102 in response to the blade movement signals. Computer control of mechanical actuators, such as hydraulic cylinder 105, is well known to those skilled in the art and will not be further discussed herein.

The procedure for determining the soil elevation behind the blade 102 using the ultrasonic transmitter and receiver 112 will now be described with reference to FIG. 3. The distance from the plane of laser light 108 to the cutting edge 103 of the blade 102, represented by distance B, is determined based on the impingement point of the plane of laser light 108 on the laser light detection means 110. When the blade 102 is cutting the soil 104, the distance from the ultrasonic transmitter and receiver 112 to the soil 104 is represented by a distance A1. In an area where the soil 104 is to be filled, the distance from the ultrasonic transmitter and receiver 112 to the soil 104 is represented by a distance A2.

Thus, the distance from the cutting edge 103 of the blade 102 to the surface of the soil 104 can be calculated as the difference between the distance A2 and the distance A1. Summing this distance A2–A1 and distance B produces the elevation of the soil 104 relative to the plane of laser light 108. Determining the distance between the plane of laser light 108 and the surface of the soil 104 as described above, eliminates the heretofore experienced problem of erroneous measurements resulting from an empty blade positioned at the required finish elevation traversing a fill area. Since a surface measurement system based solely on a laser detection mast measures the distance from the plane of laser light to the blade, such a system would improperly indicate that the soil was being filled at the proper level when, in fact, there was no soil to fill.

Having thus described the earthmoving apparatus and method of the present invention in detail and by reference to preferred embodiments thereof, it will be apparent that modifications and variations are possible without departing from the scope of the invention defined in the appended claims.

What is claimed is:

1. An earthmoving apparatus for grading a tract of land to a desired finish contour, said earthmoving apparatus comprising:

a blade for cutting and filling soil of said tract of land, said blade having a known width;

blade movement sensor means for detecting vertical movement of said blade;

elevation sensor means for detecting elevation of said soil as said earthmoving apparatus traverses said tract of land;

position sensor means for detecting x and y position of said apparatus as said apparatus traverses said tract of land; and computer means for displaying a contour map of said tract of land, said contour map having cut and fill lines thereon, and for continuously modifying said contour map as said earthmoving apparatus traverses said tract of land based on said detected elevation of said soil, said blade width, said x and y position of said apparatus and said desired finish contour.

2. The earthmoving apparatus as recited in claim 1 wherein said blade movement sensor means comprises:

a laser light transmitting means for generating a plane of light above said tract of land; and laser light detection means connected to said blade for detecting vertical movement of said blade relative to said plane of light.

3. The earthmoving apparatus as recited in claim 2 wherein said laser light detection means comprises a laser receiver mast including a linear array of photodetectors.

4. The earthmoving apparatus as recited in claim 1 wherein said elevation sensor means continuously detects elevation of a portion of said soil located behind said blade.

5. The earthmoving apparatus as recited in claim 4 wherein said elevation sensor means comprises an ultrasonic transmitter and receiver for transmitting ultrasonic waves toward said portion of said soil and for receiving reflections of said ultrasonic waves from said portion of said soil.

6. The earthmoving apparatus as recited in claim 1 wherein said computer means continuously displays said x and y position of said earthmoving apparatus on said contour map as said apparatus traverses said tract of land.

7. The earthmoving apparatus as recited in claim 1 further comprising blade movement means for automatically regulating the position of said blade in response to said x and y position of said apparatus and said desired finish contour.

8. An earthmoving apparatus for grading a tract of land to a desired finish contour, said earthmoving apparatus comprising:

a blade for cutting and filling soil of said tract of land, said blade having a known width and a cutting edge;

blade movement means for controlling vertical movement of said blade;

soil elevation means for detecting the elevation of said soil with respect to the elevation of said cutting edge of said blade;

position sensor means for detecting x and y position of said apparatus as said apparatus traverses said tract of land; and computer means for displaying a contour map of said tract of land, said contour map having cut and fill lines thereon, for continuously updating said contour map as said earthmoving apparatus traverses said tract of land based on the elevation of said soil with respect to the elevation of said cutting edge of said blade, said blade width, said x and y position of said apparatus and said desired finish contour.

9. The earthmoving apparatus as recited in claim 8 wherein said soil elevation means for detecting the elevation of said soil with respect to the elevation of said cutting edge of said blade comprises:

blade movement sensor means for detecting elevation of said blade as said apparatus traverses said tract of land; and elevation sensor means for continuously detecting the elevation of a portion of said soil located behind said blade relative to said elevation of said blade as said apparatus traverses said tract of land.

10. The earthmoving apparatus as recited in claim 9 wherein said blade movement sensor means comprises:

a laser light transmitting means for generating a plane of light above said tract of land; and a laser receiver mast including a linear array of photodetectors for detecting elevation of said blade relative to said plane of light.

11. The earthmoving apparatus as recited in claim 9 wherein said elevation sensor means comprises an ultrasonic transmitter and receiver for transmitting ultrasonic waves toward said portion of said soil and for receiving reflections of said ultrasonic waves from said portion of said soil.

12. The earthmoving apparatus as recited in claim 8 wherein said computer means continuously displays said x and y position of said earthmoving apparatus on said contour map as said apparatus traverses said tract of land.

13. The earthmoving apparatus as recited in claim 8 wherein said computer means generates blade movement signals based on said elevation of said blade, said elevation of said portion of said soil, said blade width, said x and y position of said apparatus and said desired finish contour; and said blade movement means automatically controls said blade in response to said blade movement signals as said apparatus traverses said tract of land to produce said desired finish contour.

14. A method for grading a tract of land to a desired finish contour using an earthmoving apparatus having a blade of a known width and computer means for displaying a contour map of said tract of land, said method comprising the steps of:

surveying said tract of land;

generating and displaying said contour map having cut and fill lines thereon based on said survey and said desired finish contour;

traversing said tract of land using said blade of said earthmoving apparatus to cut and fill soil of said tract of land;

sensing elevational changes of said soil as said earthmoving apparatus traverses said tract of land;

continuously determining said x and y position of said earthmoving apparatus as said earthmoving apparatus traverses said tract of land; and modifying and displaying said contour map to reflect changes in said tract of land continuously as said apparatus traverses said tract of land based on said elevational changes of said soil, said width of said blade and said x and y position of said earthmoving apparatus.

15. The method for grading a tract of land as recited in claim 14 wherein said step of modifying said contour map further comprises the step of indicating on said contour map said x and y position of said apparatus as said apparatus traverses said tract of land.

16. The method for grading a tract of land as recited in claim 14 wherein said step of sensing elevational changes of said soil comprises the step of sensing elevational changes of said soil located behind said blade.

17. The method for grading a tract of land as recited in claim 14 wherein said step of sensing elevational changes of said soil further comprises the steps of:

transmitting ultrasonic waves toward said soil located behind said blade;

detecting reflections of said ultrasonic waves from said soil located behind said blade;

calculating travel time of said waves; and determining elevation of said soil located behind said blade based on said travel time of said waves.

18. The method for grading a tract of land as recited in claim 14 wherein said step of sensing elevational changes of said soil further comprises the steps of:

transmitting a plane of laser light above said tract of land;

detecting vertical movement of said blade relative to said plane of laser light;

transmitting ultrasonic waves toward said soil located behind said blade;

detecting reflections of said ultrasonic waves from said soil located behind said blade;

calculating travel time of said waves; and determining said elevation of said soil located behind said blade based on said vertical movement of said blade and said travel time of said waves.

* * * * *